US008241089B2

(12) United States Patent
Otto

(10) Patent No.: US 8,241,089 B2
(45) Date of Patent: Aug. 14, 2012

(54) HALTER BRA

(76) Inventor: David Otto, Auckland (NZ)

( * ) Notice: Subject to any disclaimer, the term of this patent is extended or adjusted under 35 U.S.C. 154(b) by 129 days.

(21) Appl. No.: 12/446,392

(22) PCT Filed: Oct. 19, 2007

(86) PCT No.: PCT/NZ2007/000317
§ 371 (c)(1),
(2), (4) Date: Jan. 20, 2010

(87) PCT Pub. No.: WO2008/048126
PCT Pub. Date: Apr. 24, 2008

(65) Prior Publication Data

US 2010/0297915 A1 Nov. 25, 2010

(30) Foreign Application Priority Data

Oct. 19, 2006 (NZ) ..... 550674

(51) Int. Cl.
*A41C 3/00* (2006.01)

(52) U.S. Cl. ..... 450/86; 450/19; 450/21

(58) Field of Classification Search ..... 450/2, 19–21, 450/23, 34, 41, 43–44, 59, 60, 62–64, 70–76, 450/79, 83–86, 92, 93
See application file for complete search history.

(56) References Cited

U.S. PATENT DOCUMENTS 3,516,415 A * 6/1970 Hadley-Webb ..... 450/65
3,834,397 A * 9/1974 Birch ..... 450/56
4,289,137 A 9/1981 Dell et al.
4,393,875 A * 7/1983 O'Boyle et al. ..... 450/1
4,432,364 A 2/1984 Martini
4,453,549 A * 6/1984 DiTullio ..... 450/74
5,045,019 A * 9/1991 Capasso et al. ..... 450/74
5,167,566 A * 12/1992 Novitsky et al. ..... 450/74
5,643,043 A 7/1997 Pflum
5,660,577 A * 8/1997 Modena ..... 450/86
5,662,512 A 9/1997 Cohen
5,823,851 A * 10/1998 Dicker ..... 450/2
5,873,767 A 2/1999 Pickett
6,110,007 A 8/2000 Rittmann
2001/0019933 A1 9/2001 Wagner

FOREIGN PATENT DOCUMENTS

EP 1 283 016 11/2002
WO 95/22261 8/1995

OTHER PUBLICATIONS

Great Britain Examination Report—GB0908596.0—Mar. 17, 2011.
New Zealand Examination Report—577057—Dec. 13, 2010.
Bendon Bodysculpt Sports Bra Feb./Jul. 2007 Retailers Catalogue.

* cited by examiner

*Primary Examiner* — Gloria Hale
(74) *Attorney, Agent, or Firm* — Young & Thompson

(57) ABSTRACT

A Halter Bra is disclosed which has a support frame (F) with a first side portion and a second side portion and a base portion between the side portions. The side portions extend laterally from the base portion. A first quarter cup (A) is dependent from the base portion and the first side portion and a second quarter cup is dependent from the base portion and the second side portion. The support frame (F) is preferably bound with elastic binding material (B1, B2) on each side portion and on the base portion.

13 Claims, 8 Drawing Sheets

HALTER BRA

FIELD OF THE INVENTION

This invention relates to wearable devices for re-shaping and/or supporting breast tissue, such as those commonly referred to by the term 'Halter Bra'.

BACKGROUND

There are a number of different types of Halter Bra's, the main application being in swimwear. Some Halter Bra's have removable shaped pads. All breast cups are triangular in some format and shape.

Conventional Halter Bra's have a pleat generally in the centre of breast cup to achieve cleavage and support. However, one serious drawback apart from comfort, is that the halter strap comes from the breast cup at a very acute angle. This is problematic in some instances, for example a user of a conventional Halter Bra can only utilize a garment that allows for this acute strap angle, which severely limits the range of garments (particularly fashion garments) that can be worn.

OBJECT

It is the object of the present invention to provide a Halter Bra, which overcomes one or more disadvantages of known constructions. Alternatively, it is an object of the invention to provide a Halter Bra that at least provides a useful choice or alternative to known constructions of Halter Bras or similar devices.

BRIEF SUMMARY OF INVENTION

In a first aspect the present invention provided a Halter Bra having a support frame with a first side portion and a second side portion and a base portion between the side portions, the side portions extending laterally from the base portion, a first quarter cup dependent from the base portion and the first side portion and a second quarter cup dependent from the base portion and the second side portion.

Accordingly in a second aspect the invention provides a Halter Bra having a support frame with a first side portion and a second side portion and a base portion between the side portions, the side portions extending laterally from the base portion, a first quarter cup dependent from the base portion and the first side portion and a second quarter cup dependent from the base portion and the second side portion, the support frame bound with elastic binding material on each side portion and on the base portion.

Accordingly in a third aspect the invention provides a Halter Bra having a support frame with a first side portion and a second side portion and a base portion between the side portions, the side portions extending laterally from the base portion, a first quarter cup dependent from the base portion and the first side portion and a second quarter cup dependent from the base portion and the second side portion, the support frame having a plurality of length(s) of elastic binding material overlaid on each side portion and on the base portion.

The quarter cups containing the breast tissue have an upper edge that is defined as a gentle convex curvature. The quarter cup is bound with binding elastic on the top edge of the quarter cup and then inserted into the upper edge of the frame that is longitudinally curvilinear. Overlaying binding elastic is utilized in our invention as overlaying produces a more efficient result rather than the conventional piece of elastic or elastic panels.

In the present invention the centre front has three pieces of binding elastic overlaid. The first in conjunction with 'recepticon' units (receptor and connector) provides some movement to an inelastic frame. The second, a degree more movement, while the third provides containment of the breast tissue.

The binding elastic is preferably oriented vertically along the length of each side portion and horizontally across the control portion. The horizontal lengths may begin at the central connection area and extend to meet the vertically oriented elastic of the side portion.

The three pieces of binding elastic are in a more horizontal than vertical format. The exterior edge of the frame has four pieces of binding elastic, overlaid in a more vertical than horizontal format.

The first overlaid piece of binding elastic starts the process of gently turning the quarter cup. The second increases the turning, the third and fourth provide containment and efficiency to achieve the desired result of the breast re-shaping of the breast tissue contained in the quarter cups.

The fourth piece of overlaid binding elastic provides with the top edge of quarter cup and the centre front, a better-finished product.

The quarter cups contained in the frame are preferably disconnectable in the centre front by units known respectively as connectors and receptors. The combination is referred to herein as a 'recepticon'.

Alternatively other units for disconnection could be utilized, but these are less efficient than the present invention. Alternatively the centre front could be closed and not utilized in any form of disconnection.

The straps, which are preferably disconnectible from all units, including all intersection regions, utilize three way connection means (referred to herein as tri-units) with 'recepticon' components.

Alternatively a 'recepticon' unit consisting of a receptor and a connector only, can be utilized rather than the tri-unit, which utilizes three receptors or connectors attached to a central ring form to the tri-unit.

The areas of disconnection utilizing 'recepticon' units themselves, are preferable to fixed units in the areas formally mentioned, although the end result would still be achieved. However the fixed units would decrease the commercial viability.

The straps include two halter straps. Each halter strap is provided from an upper disconnectable point on each side portion to the intersection region and the construction and arrangement being such, that in use each halter strap extends from the respective upper connection point to the lateral muscular area of the neck.

Alternatively the units could be fixed. Preferably the angle between the halter straps relative to the intersection region is variable, rather that the fixed acute degree angle of conventional halter bras.

The construction and arrangement of the halter straps is such that in use, the halter straps are nearer to the lateral muscular area of the neck, rather than the shoulder. The unique placement of the tri-units on respective vertebrae enables a variable angle to allow more flexibility in the wearing of a fashion garment.

An additional unit can be attached to the lower edge of the binding elastic in the centre front, which preferably also contains three 'recepticon' units. This enables a lower vertebral option to be achieved with more balance and more flexible options of an attached skirt. The lower panel attached to the binding elastic is more horizontal than vertical.

According to a further aspect of the present invention there is provided a brassiere having a support frame with a central base portion between two side portions, each side portion extending in a lateral upward direction from the central portion, and two breast quarter cups, each cup provided between a respective side portion and a part of the central portion, and straps which connect at an intersection region at the back of the user and are connected or connectable to the support frame to allow the brassiere to be worn by a user, the straps including two upper straps, each upper strap provided from an upper connection point on each of the side portions to the intersection region, and two lower straps, each lower strap provided from a lower connection point on each of the side portions to the intersection region, and the construction and arrangement being such that in use each upper strap extends from the respective upper connection point over a shoulder to the intersection region, and each lower strap extends from the respective lower connection point under the respective arm to the intersection region.

Further aspects of the invention, which should be considered in all its novel aspects, will become apparent from the following description given by way of example of possible embodiments of the invention.

BRIEF DESCRIPTION OF THE DRAWINGS

One or more embodiments will be described by way of example with reference to the accompanying drawings in which.

DETAILED DESCRIPTION OF THE DRAWINGS

Figure 1:
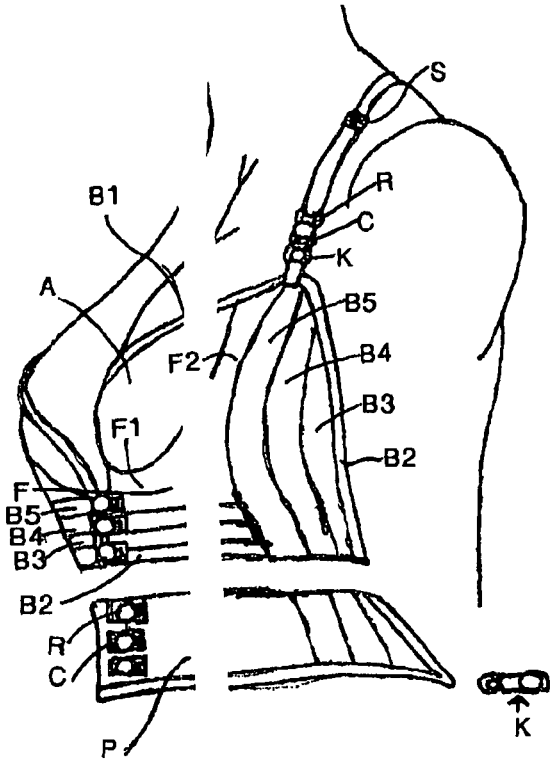
FIG. 1 Is a left side view of a bra according to the invention with a lower support unit shown separated therefrom.
Figure 2:
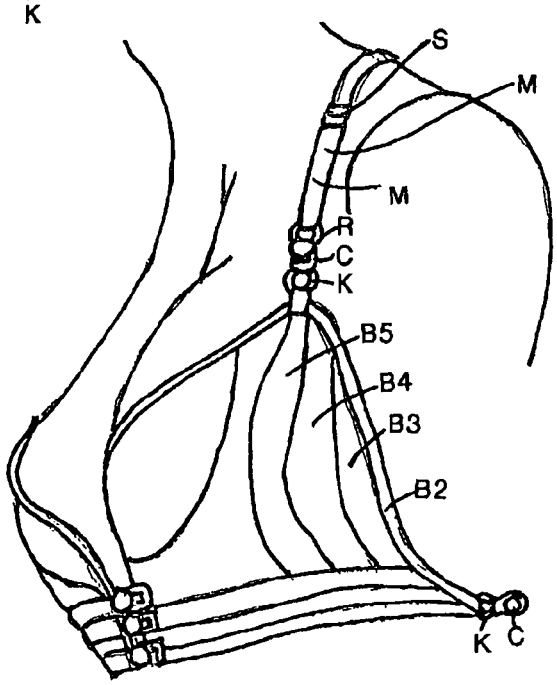
FIG. 2 Is a left side view of an alternative embodiment without the lower support unit.

A number of embodiments of the invention will be described with reference to the drawing figures in which like reference characters relate to like components. The drawings show a halter bra having frame part F. The frame parts may be constructed as a single component, or may be separable, being joined by connection means comprising first and second engagable connector parts R and C as shown in the drawings. As shown in the drawings, the frame includes a lower portion F1 which preferably gradually makes a smooth transition to a side portion F2 which extends on a lateral upward direction from the lower portion. This general form of frame construction is described in New Zealand patent application no. 550674, the contents of which are incorporated herein by reference. In the present invention the frame supports quarter cups A which have a length of elastic binding material B1 which traverses the upper reach of the quarter cup and frame. The upper reach of the quarter cup is preferably slightly convex relative to the frame (i.e. curves outwardly slightly relative to the frame). As seen in the figures, each of the quarter cups A is sized and configured to contact only a lower portion of a breast. Along the side portion of the frame are a number of lengths of binding elastic. In the embodiment shown there are three lengths of elastic which are elongate and which assist shaping of the frame and cup construction in use. The main lengths of elastic that contribute to this function are labeled B3, B4 and B5. There is also a length B2 at the peripheral edge of the construction. Similar lengths of elastic material are provided across the base of the frame, and these are also labeled B2, B3 and B4. The pieces of elastic B3, B4 and B5 at the side and B3 and B4 at the base of the frame are overlaid as this produces a more efficient result rather than the use of a single piece of elastic or the use of specific elastic panels. The first overlaid piece of binding elastic B2 starts the process of gently turning the quarter cup to provide a desired shape or form. The second increases the turning effect, the third and fourth provide containment and efficiency to achieve the desired result of reshaping the breast tissue contained in the quarter cup. The elastic at the outer peripheral edges B1 and B2 provides the edges of the quarter cup and the periphery of the frame with a good finish.

As can be seen from the drawings, a lower support panel P may be used. The support P may broadly comprise part of the frame, and may be provided with Connector parts C or R (as with the remainder of the bra). The lower support portion can provide additional benefits in the support to the user, but is not essential.

Figure 3:
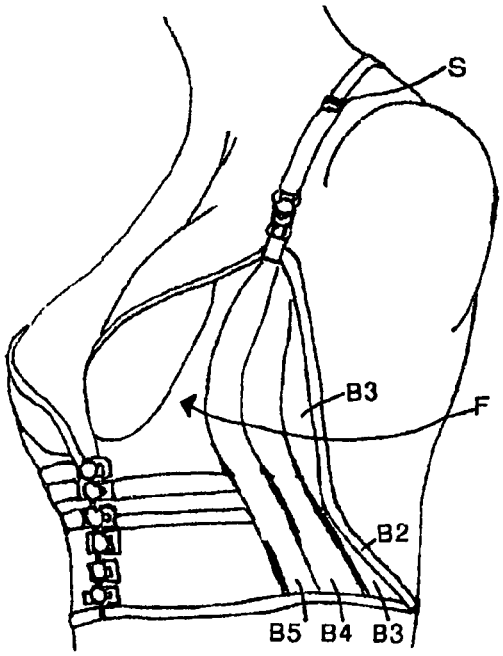
FIG. 3 Is a left side view of the apparatus of the FIG. 1, including the lower support unit affixed to the bra.
Figure 4:
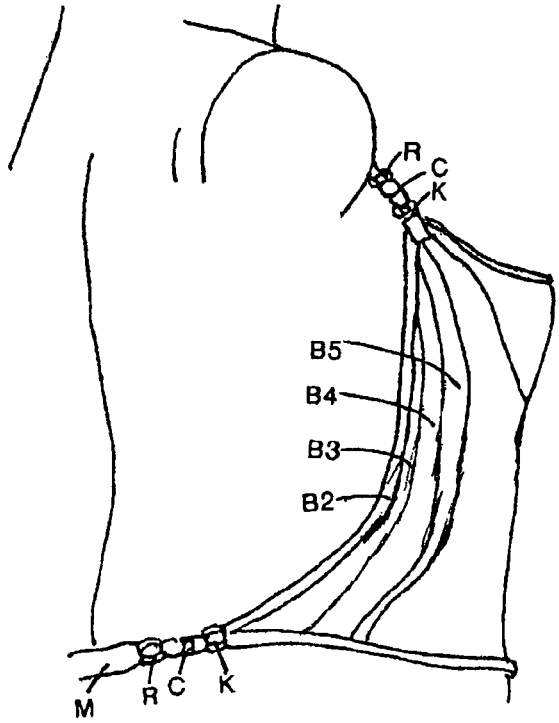
FIG. 4 Is a right side view of an alternate embodiment.

The lengths of binding elastic along the outer part of the side portions of the frame extend continuously along the full length of the side portion as shown in FIGS. 1, 3 and 4.

Figure 5:
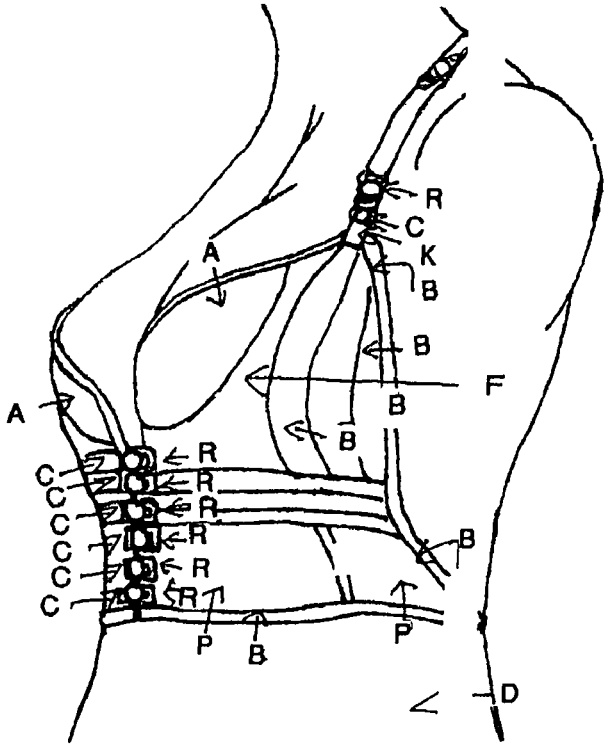
FIG. 5 Is a left side view of the apparatus of the preceding Figures incorporated into a garment.
Figure 6:
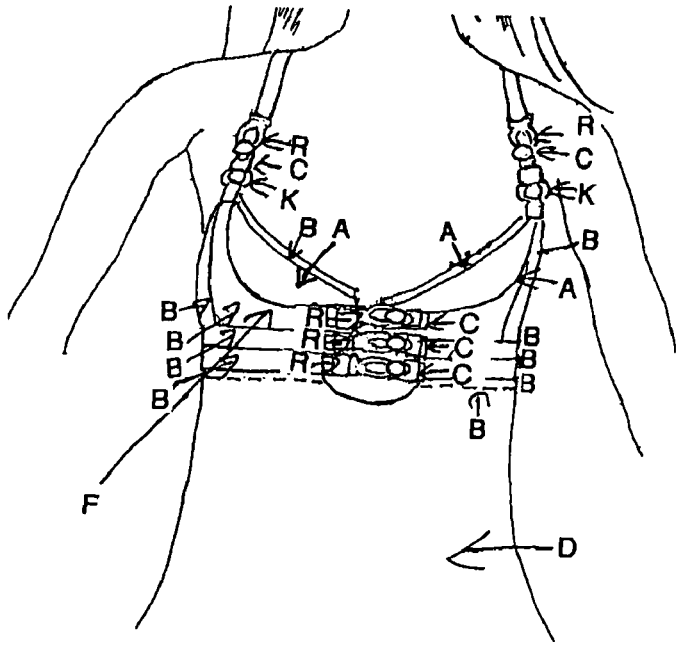
FIG. 6 Is a front view of the apparatus of FIG. 2 incorporated into a garment.
Figure 7:
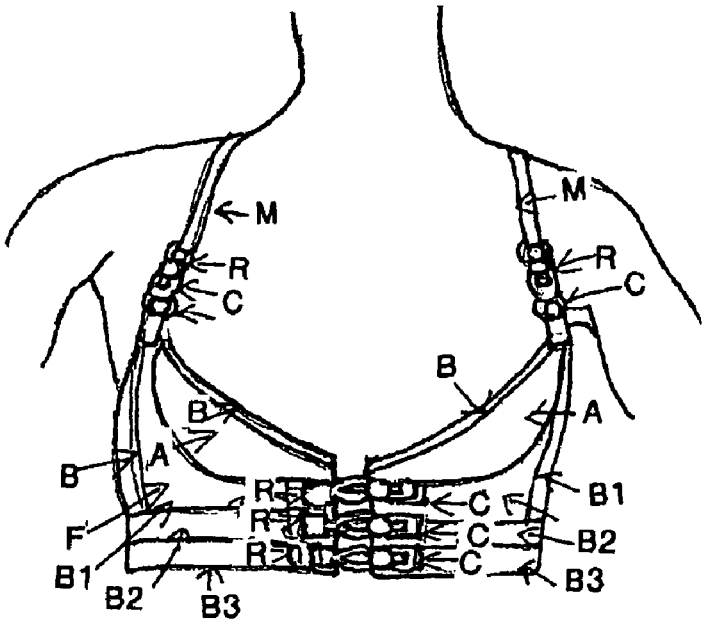
FIG. 7 Is a front view of the apparatus of FIG. 2.
Figure 8:
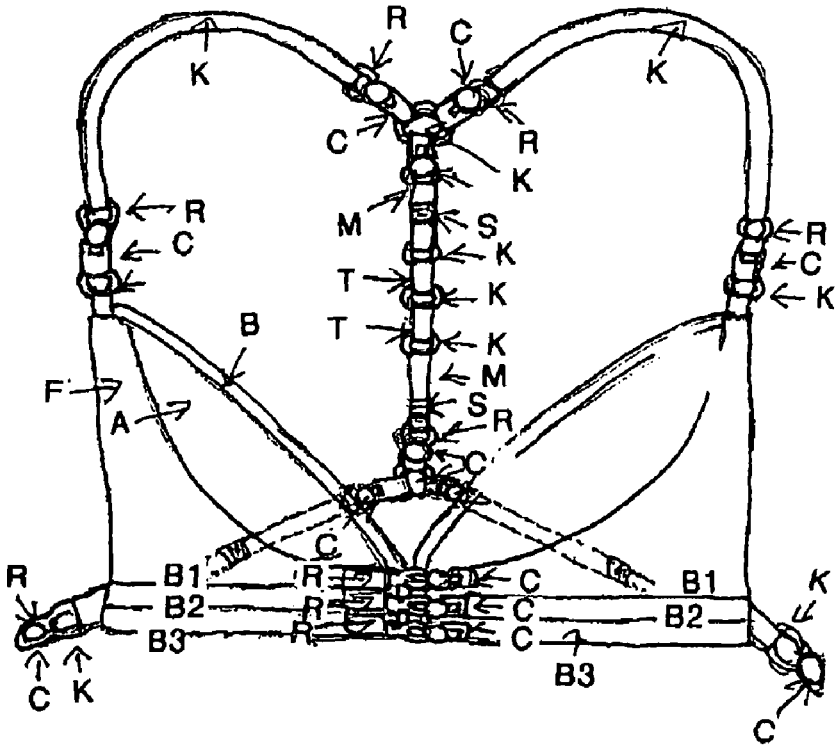
FIG. 8 Is a rear view of the apparatus of FIG. 7.

In FIGS. 5 and 6, the construction with and without the support portion respectively is shown as part of a garment such as a dress reference D. Therefore, the bra construction according to the invention can be provided on its own, or as part of a garment.

Connector parts are provided to allow connections to be established with straps adjacent to the upper most point of the side of the frame, and at or adjacent to the lower most point of the side of the frame (or at the lower outer point of the lower support P). Therefore the straps may be disconnectable, as in the embodiments shown, and a range of different strap connections options and arrangements is provided as will be described below.

Figure 9:
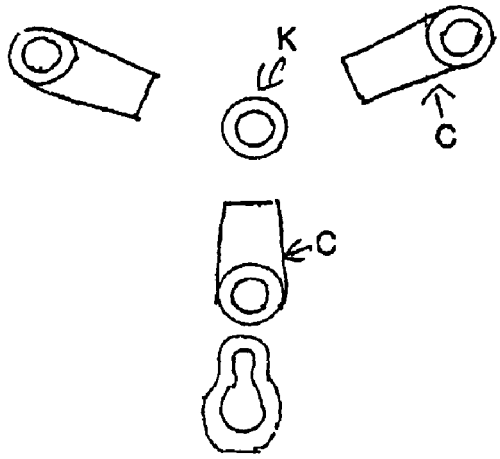
FIGS. 9 & 10 Are exploded views of tri-unit connector units for use with the apparatus of the preceding Figures.
Figure 10:
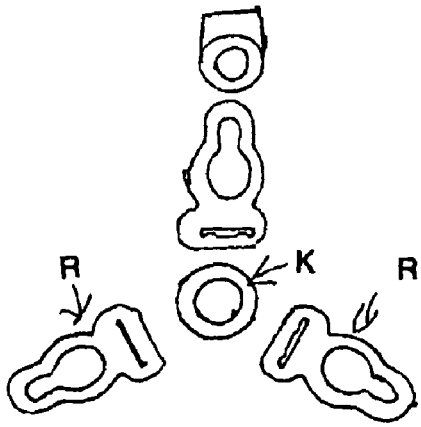

Referring to FIGS. 9 and 10, three way connection means, which are referred to herein as "Tri Units", are shown. These comprise a central ring or loop which carries three first connector parts C. Each first connector part C may include a loop of material which is looped through ring K and is then fastened to the first connector part C to fasten it to the ring. Each first connector part C has a projection with a mushroom head labeled C1. The head C1 can be inserted into an aperture in a second connector part R such that portion R1 of the second connector part R is provided about a stem beneath the mushroom head C1 of the connector part C. Similarly, the Tri Unit may be constructed as shown in FIG. 10 in which the second connector parts R are attached, using loops of material (not shown), with a central ring K, and may then be engaged with connector parts C which are in turn connected to straps.

Figure 11:
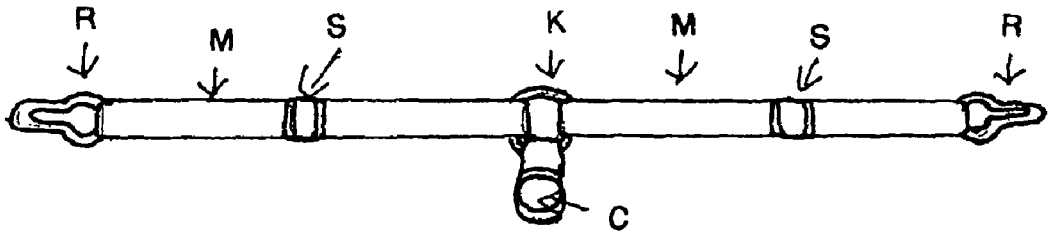
FIG. 11 Is an assembled view of a further embodiment of the connector unit for use with the apparatus of the preceding Figures.
Figure 12:
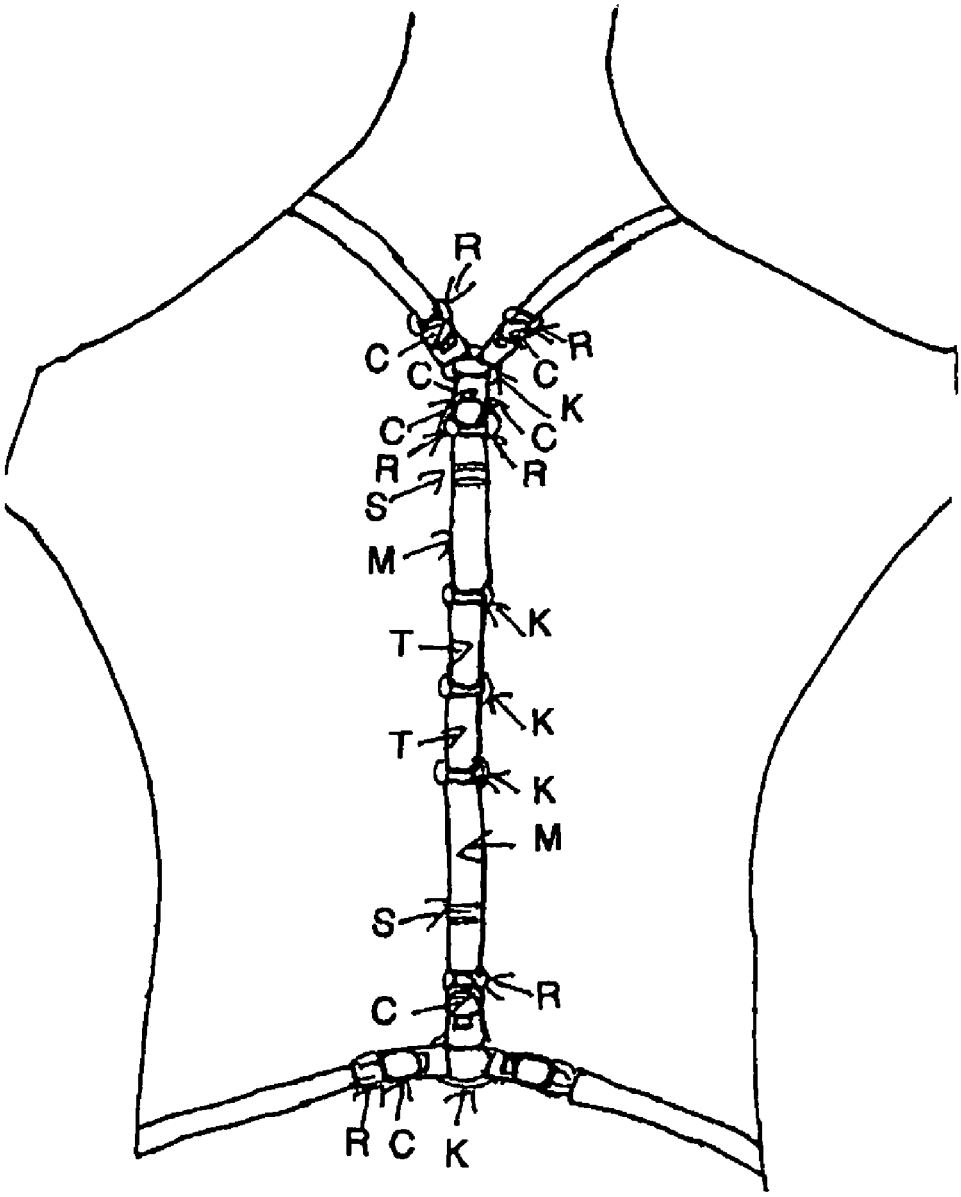
FIGS. 12 & 13 Are rear views of the apparatus of the preceding Figures showing different arrangements of connector units to achieve the required fit.
Figure 13:
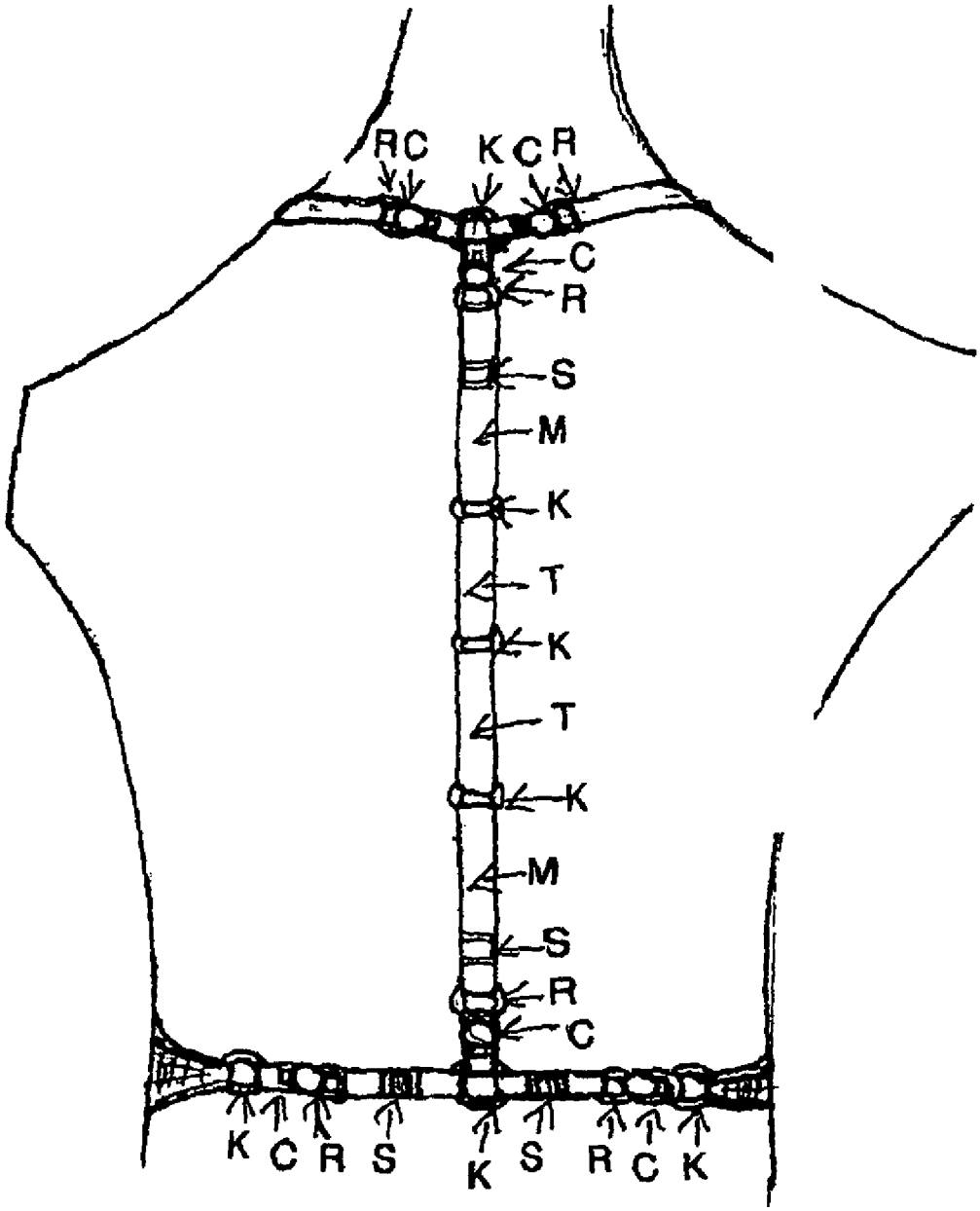

In FIG. 11 an alternative Tri Unit arrangement is shown which includes straps M (which in one embodiment are inelastic) that may be lengthened or shortened in the known way through the use of slides S.

Turning now to FIGS. 7, 8, 12 and 13 it can be seen that a variety of different strap arrangements can be used. In these Figures, strap parts M are inelastic and strap parts T are elastic so that they may provide additional tensioning as required.

Figure 14A:
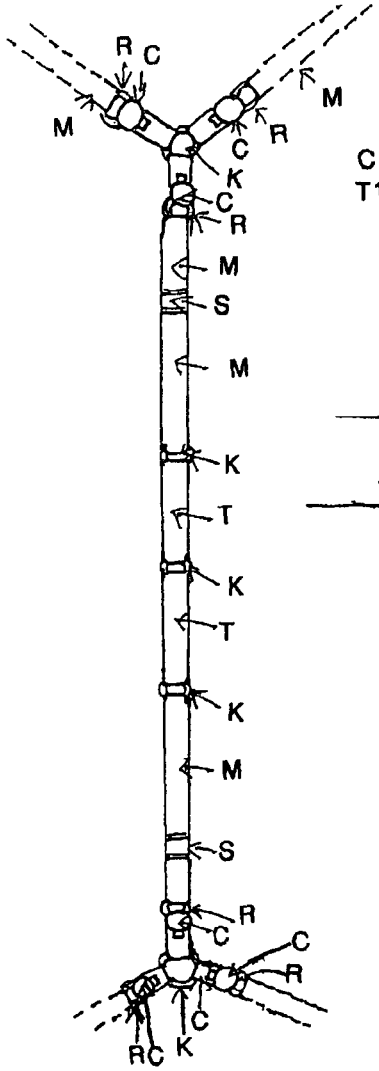
FIGS. 14A & 14B Illustrate use of connector units to achieve a desired placement of strap connections at different vertebrae on the human spine.
Figure 14B:
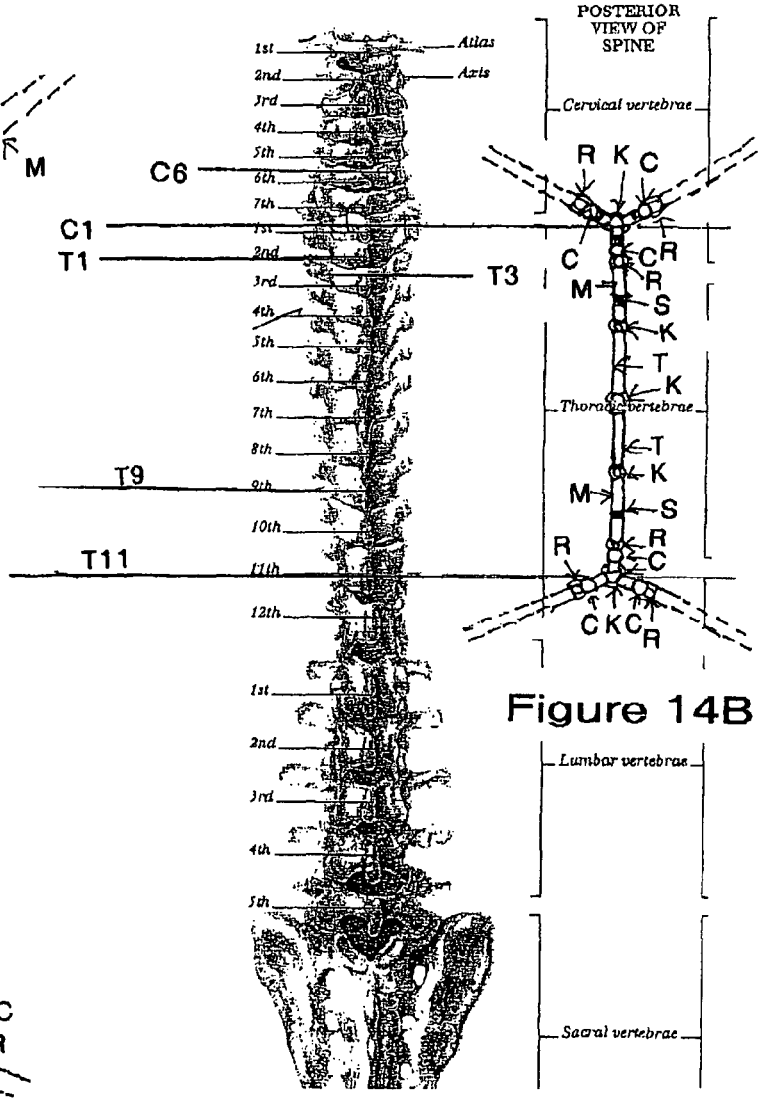

The arrangements can also be illustrated in relation to the human spine as shown in FIGS. 14A and 14B which show the position of various connections or Tri Units in relation to the human spine. As can be seen in FIG. 14A the Tri Units can be arranged to provide a strap intersection region between C7 and T11 vertebrae or between C7 vertebrae and the base of the spine depending upon the arrangements used. Furthermore, the apparatus may be provided without any connection between the uppermost connector which connects the halter straps and the lower most connection which connects the lower bra straps. Therefore, the connector units used with the invention do not need to be Tri Units.

One particular advantage of the various connections that are possible is that the halter straps of the Halter Bra can be provided at various angles which allows a variety of different garments to be worn with the bra.

In one embodiment the construction and arrangement of the halter straps is such that in use these straps are nearer to the lateral muscular area of the neck rather than the shoulder. The neck placement of connector units on respective vertebrae enables a variable degree of angle to allow more flexibility in the wearing of fashion garments and more comfort to the user.

The lower support unit together with the connectors allow a lower vertebra option to be achieved as shown in FIG. 14A with more balance and more flexible options for an attached skirt or other garment.

The connector of FIG. 14A may be utilized in conjunction with the Halter Bra having an attached support portion P. This arrangement allows a lower vertebrae to be chosen together with adjustable straps. Other versions of the connector may not allow the adjustment required.

The components of the connector units can be miniaturized in clear or opaque plastic materials depending on the required aesthetics.

When a connector unit is located between the C7 and T1 vertebrae, the C7 vertebrae gives flexibility and movement and the location of the T1 vertebrae gives maximum strength to the unit supporting the quarter cups. This is completed by the lower back T9 vertebrae. When the support panel P is attached to the lower edge of the bra then a lower vertebrae can be chosen, namely T11. This gives the wearer a lower back décolletage which is especially useful in swimwear. When the support panel P is utilized the spinal strap (i.e. the strap between the upper and lower connector units) can be disconnected if desired, for example for sunbathing. With location of the connector unit at T3 vertebrae the halter straps move closer to the shoulder area rather than the neck. This allows the halter straps to decrease the angle relative to each other giving a better décolletage in the frontal area which makes the invention more viable for use with fashion garments including swimwear as opposed to the standard halter bras that are currently in use.

Finally, the combination of a series of receptors and connectors as dual units is utilized in the centre of the bra in order to attach the two bra parts together and is also in the support panel P.

Where in the foregoing description, reference has been made to specific components or integers of the invention having known equivalents, then such equivalents are herein incorporated as if individually set forth.

Although this invention has been described by way of example and with reference to possible embodiments thereof, it is to be understood that modifications or improvements may be made thereto without departing from the spirit or scope of the invention.

The invention claimed is:

1. A Halter Bra having a support frame with a first side portion and a second side portion and a base portion between the side portions, the side portions extending laterally from the base portion, a first quarter cup dependent from the base portion and the first side portion and a second quarter cup dependent from the base portion and the second side portion, each of the first and second quarter cups sized and configured to contact only a lower portion of a breast, the support frame having a plurality of lengths of elastic binding material on each of the side portions and the base portion, each length of binding material overlaid on an adjacent length of binding material in each said side portion and on the base portion.

2. A Halter Bra as claimed in claim 1 wherein the binding material shapes breast tissue by turning the quarter cups to provide a selected shape.

3. The Halter Bra as claimed in claim 1 wherein the base portion is provided in two parts and includes connection means to connect and disconnect the base portion parts.

4. A Halter Bra as claimed in claim 1 including first and second halter straps respectively attached to each upper region of each side portion and first and second lower straps respectively attached to each lower region of each side portion of the frame wherein the first and second halter straps are connectable to each other at a halter connection point and the first and second lower straps are connectable to each other at a lower strap connection point.

5. The Halter Bra as claimed in claim 4 further comprising a rear central strap connecting the halter connection point to the lower strap connection point.

6. A Halter Bra as claimed in claim 5 wherein the halter straps are connected to the central strap by a three way connector.

7. A Halter Bra as claimed in claim 5 wherein the lower straps are connected to the central strap by a three way connector.

8. A Halter Bra having a support frame with a first side portion and a second side portion and a base portion between the side portions, the side portions extending laterally from the base portion, a first quarter cup dependent from the base portion and the first side portion and a second quarter cup dependent from the base portion and the second side portion, each of the first and second quarter cups sized and configured to contact only a lower portion of a breast the support frame bound with a plurality of lengths of elastic binding material on each said side portion and on the base portion.

9. A Halter Bra having a support frame with a first side portion and a second side portion and a base portion between the side portions, the side portions extending laterally from the base portion, a first quarter cup dependent from the base portion and the first side portion and a second quarter cup dependent from the base portion and the second side portion, each of the first and second quarter cups sized and configured to contact only a lower portion of breast tissue.

10. A Halter Bra as claimed in claim 8 wherein the lower straps are connected to the central strap by a three way connector.

11. The Halter Bra as claimed in claim 8 wherein the base portion is provided in two parts and includes connection means to connect and disconnect the base portion parts.

12. A Halter Bra as claimed in claim 8 including first and second halter straps respectively attached to each upper region of each side portion and first and second lower straps respectively attached to each lower region of each side portion of the frame wherein the first and second halter straps are connectable to each other at a halter connection point and the first and second lower straps are connectable to each other at a lower strap connection point.

13. A Halter Bra as claimed in claim 3 including first and second halter straps respectively attached to each upper region of each side portion and first and second lower straps respectively attached to each lower region of each side portion of the frame wherein the first and second halter straps are connectable to each other at a halter connection point and the first and second lower straps are connectable to each other at a lower strap connection point.

* * * * *